US012291314B2

(12) United States Patent
Redburn

(10) Patent No.: US 12,291,314 B2
(45) **Date of Patent: *May 6, 2025**

(54) ACCESSORY ATTACHMENT SYSTEM FOR WATERCRAFT

(71) Applicant: Keith Redburn, Bay City, MI (US)

(72) Inventor: Keith Redburn, Bay City, MI (US)

( * ) Notice: Subject to any disclaimer, the term of this patent is extended or adjusted under 35 U.S.C. 154(b) by 83 days.

This patent is subject to a terminal disclaimer.

(21) Appl. No.: 17/850,634

(22) Filed: Jun. 27, 2022

(65) Prior Publication Data

US 2022/0324539 A1 Oct. 13, 2022

Related U.S. Application Data

(63) Continuation-in-part of application No. 17/696,604, filed on Mar. 16, 2022.

(60) Provisional application No. 63/297,977, filed on Jan. 10, 2022, provisional application No. 63/215,275, filed on Jun. 25, 2021, provisional application No. 63/161,876, filed on Mar. 16, 2021.

(51) Int. Cl.
*B63B 34/10* (2020.01)
*A45F 3/24* (2006.01)

(52) U.S. Cl.
CPC ..... *B63B 34/10* (2020.02); *A45F 3/24* (2013.01)

(58) Field of Classification Search
CPC ..... B63B 34/10; B63B 34/107; B63B 17/00; A45F 3/24
See application file for complete search history.

(56) References Cited

U.S. PATENT DOCUMENTS

| | | | | |
|---|---|---|---|---|
| 3,266,761 | A * | 8/1966 | Walton | F16L 3/1207 174/164 |
| 3,802,655 | A * | 4/1974 | Schuplin | F16L 3/1207 248/62 |
| 5,295,646 | A * | 3/1994 | Roth | F16L 3/133 248/62 |
| 5,423,565 | A | 6/1995 | Smith | |
| 6,023,792 | A | 2/2000 | Croucher et al. | |
| 6,695,336 | B1 | 2/2004 | Grabenstetter | |
| 6,701,913 | B1 | 3/2004 | LeDuc et al. | |
| 7,014,400 | B1 * | 3/2006 | LaBelle | B60P 7/0815 410/104 |
| 7,516,922 | B1 * | 4/2009 | Kirschner | F16L 3/1091 248/65 |
| 8,485,207 | B1 | 7/2013 | Boyington | |
| 8,602,440 | B2 | 12/2013 | Kenjora | |
| 2003/0205599 | A1 | 11/2003 | Brown | |
| 2018/0222375 | A1 * | 8/2018 | Tyler | A47C 17/80 |

(Continued)

*Primary Examiner* — Stephen P Avila
(74) *Attorney, Agent, or Firm* — Poznak Dyer Kanar Schefsky Thompson, PLC; Robert C. Corbett

(57) ABSTRACT

An accessory attachment interface usable with watercraft includes a one-piece member having a tubular portion and a flange portion. The tubular portion defines a cylindrical bore and the flange portion defines first and second flanges. The first and second flanges are coplanar with each other and with a plane that is tangential to the tubular portion. The first and second flanges cooperate with each other to define a substantially planar surface. The accessory attachment interface provides a boat owner with a common interface for mounting a variety of hardware and accessories to the boat without occupying any space in the passenger area of the boat.

2 Claims, 10 Drawing Sheets

(56) References Cited

U.S. PATENT DOCUMENTS

| | | | | |
|---|---|---|---|---|
| 2020/0298936 | A1* | 9/2020 | Fournier | B63B 34/00 |
| 2022/0119076 | A1* | 4/2022 | Kreuser | B63B 17/02 |

* cited by examiner

ACCESSORY ATTACHMENT SYSTEM FOR WATERCRAFT

CROSS-REFERENCE TO RELATED APPLICATION

This application is a continuation-in-part of U.S. patent application Ser. No. 17/696,604, filed Mar. 16, 2022, which claims the benefit of U.S. provisional patent application No. 63/161,876, filed Mar. 16, 2021, each of which is being hereby incorporated by reference in its entirety. This application also claims the benefit of U.S. Provisional Patent Application No. 63/215,275, filed Jun. 25, 2021, and U.S. Provisional Patent Application No. 63/297,977, filed Jan. 10, 2022, each of which being hereby incorporated by reference in its entirety.

TECHNICAL FIELD

This disclosure relates to devices for attaching accessories to watercraft and other marine features.

BACKGROUND OF THE INVENTION

Boats and other watercraft are often used in conjunction with various accessories. In the case of recreational boating, for example, various recreational activities involve the use of devices and components that are used on or adjacent to the boat.

SUMMARY

An accessory attachment interface usable with watercraft includes a one-piece member having a tubular portion and a flange portion. The tubular portion defines a cylindrical bore and the flange portion defines first and second flanges. The first and second flanges are coplanar with each other and with a plane that is tangential to the tubular portion. The first and second flanges cooperate with each other to define a substantially planar surface.

The accessory attachment interface provides a boat owner with a common interface for mounting a variety of hardware and accessories to the boat without occupying any space in the passenger area of the boat. The one-piece construction enables the interface to be manufactured by extruding a metal blank.

One accessory that is mountable to a watercraft or other object via the interface is a hammock support system. Brackets are engageable with multiple accessory attachment interfaces mounted below the deck of a boat to support a hammock above the body of water in which the boat is operating.

The above features and advantages and other features and advantages of the present disclosure are readily apparent from the following detailed description of the best modes for carrying out the disclosure when taken in connection with the accompanying drawings.

DESCRIPTION OF THE PREFERRED EMBODIMENTS

Figure 1:
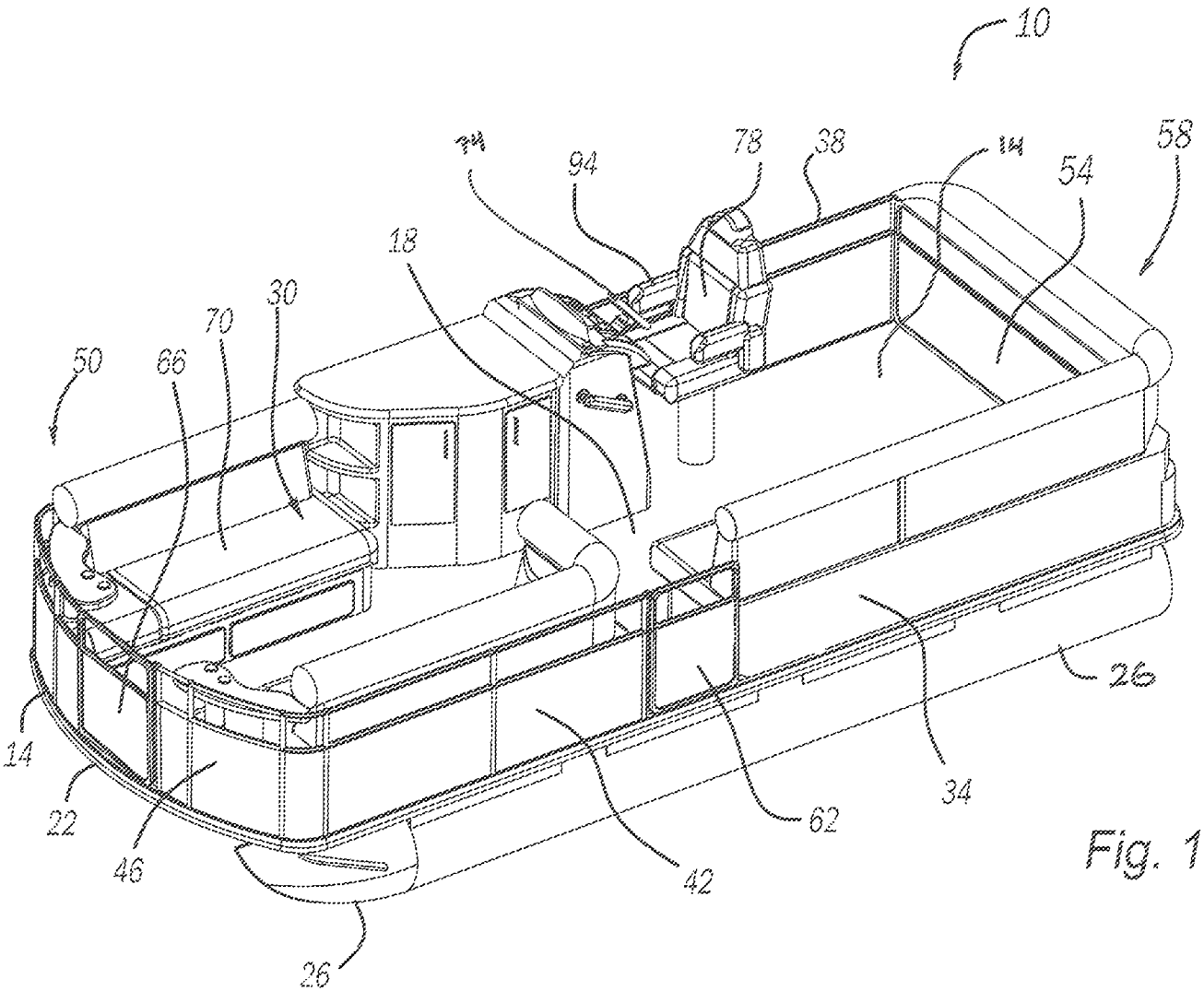
FIG. 1 is a schematic, perspective view of a pontoon boat.

Referring to the Figures, wherein like reference numbers refer to like components throughout, an attachment interface for attaching hardware and accessories to a watercraft or other mounting surfaces is schematically depicted. Referring specifically to FIG. 1, a pontoon boat 10 includes a platform or deck 14 having an upper surface 18 and a lower surface 22. The deck 14 is mounted with respect to pontoons 26, as understood by those skilled in the art. The upper surface 18 defines the floor of a passenger area 30. The pontoon boat 10 includes fencing 34 mounted to the deck 14 and extending upward from the upper surface 18.

The fencing 34 includes side portions 38, 42 that extend fore and aft or longitudinally along respective sides of the upper surface 18. The fencing 34 also includes a forward portion 46 at or adjacent to the bow 50. The forward portion 46 is generally perpendicular to, and interconnects, the side portions 38, 42. A rear portion 54 of the fencing 34 is at or adjacent to the stern 58. The rear portion 54 is generally perpendicular to, and interconnects, the side portions 38, 42. In the embodiment depicted, one of the side portions 42 includes a gate 62. Similarly, the forward portion 46 includes a gate 66.

The fencing 34 surrounds the passenger area 30, which may include seating assemblies 70, a steering wheel 74, a captain's chair 78, etc. The pontoon boat 10 may include a selectively retractable awning or canopy (not shown) as understood by those skilled in the art.

FIGS. 2-7, wherein like reference numbers refer to like components from FIG. 1, schematically depict an accessory attachment interface for use with the boat 10. In FIGS. 2-7, only the pontoons 26 and deck 14 of the boat 10, along with a receiver 86 and accessory attachment system 80, are shown for clarity and simplicity. Referring to FIGS. 2-7, the receiver 86 includes a tubular portion 88 and a flange portion 90; in the embodiment depicted, the tubular portion 88 is cylindrical, though other shapes may be employed within the scope of the claimed invention. The flange portion 90 defines a plurality of holes for mounting the receiver 86 to a surface of the boat 10 with fasteners. In the embodiment depicted, the receiver 86 is mounted to the lower surface 22 of the deck 14. In the embodiment depicted, the boat 10 includes two receivers 86 mounted under the deck 14 adjacent the bow; each receiver 86 is on a respective side of the boat 10.

Figure 2:
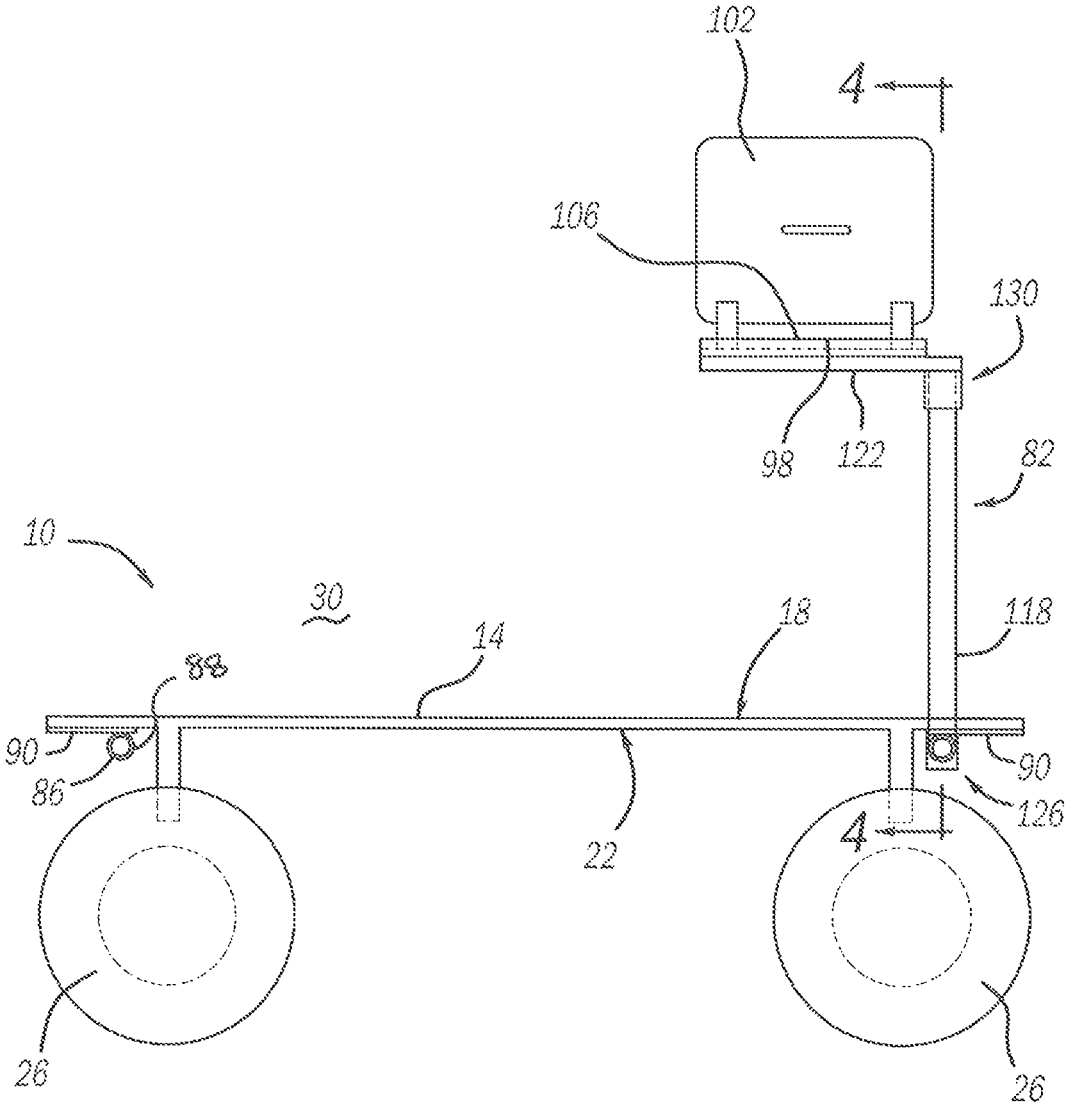
FIG. 2 is a schematic, cross-sectional, rear view of the boat of FIG. 1 with an accessory attachment system operatively connected thereto in a first configuration.
Figure 3:
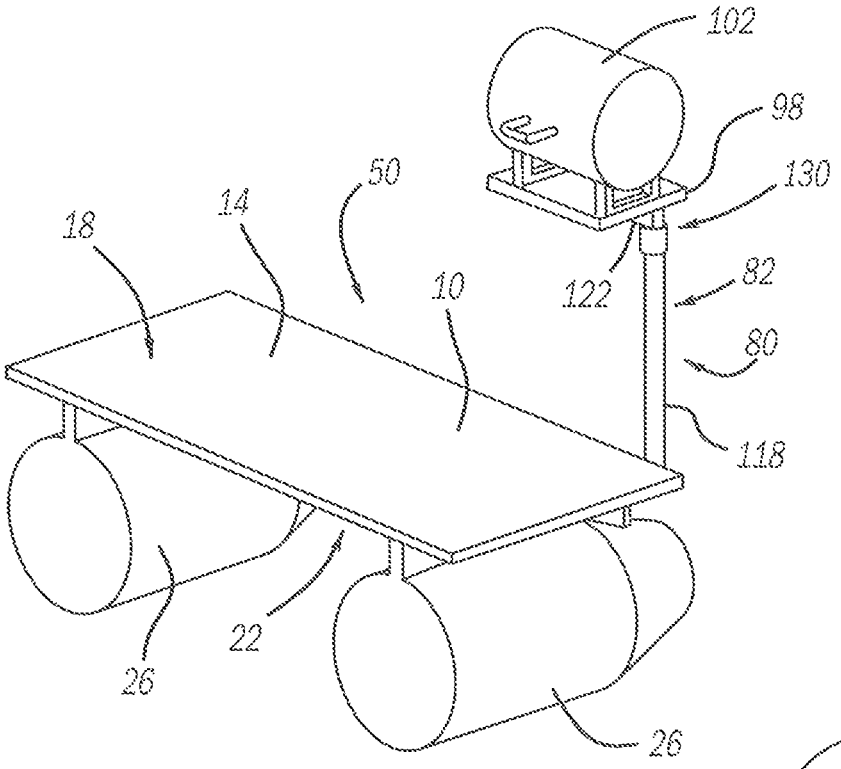
FIG. 3 is a schematic, perspective view of a portion of the boat and accessory attachment system in the first configuration.
Figure 4:
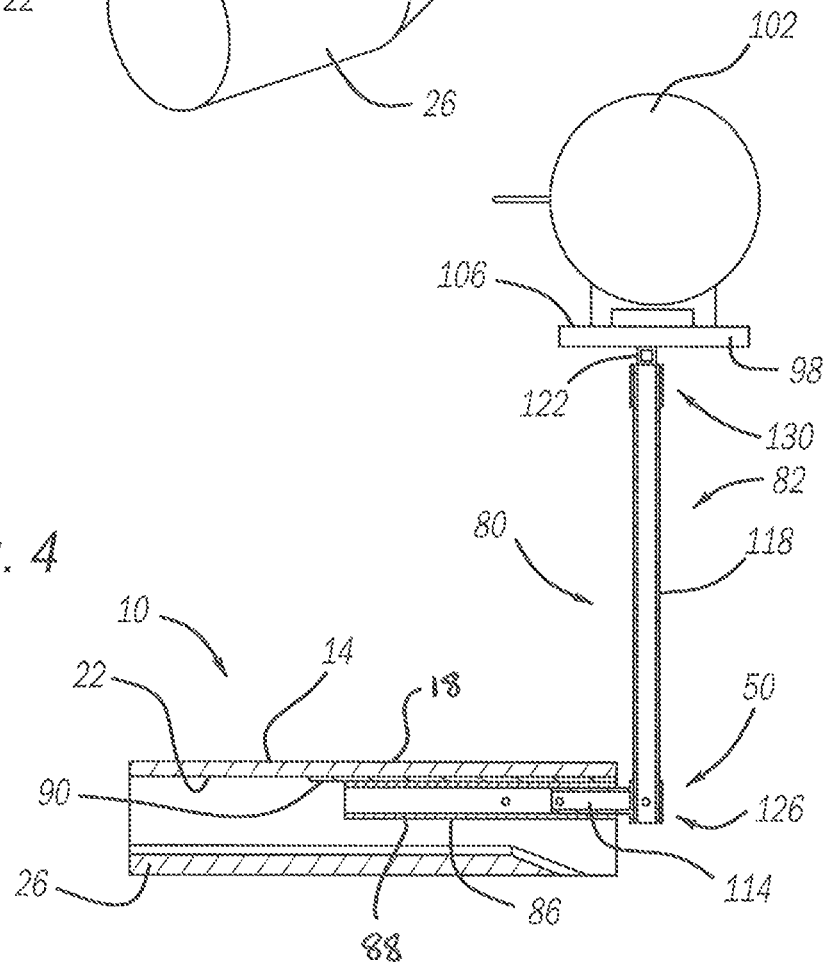
FIG. 4 is a schematic, cross-sectional, side view of a portion of the boat and the accessory attachment system in the first configuration.

An accessory mounting system includes a mechanism 82 that is attachable to the boat 10 via one of the receivers 86. The mechanism 82 includes an accessory holding portion 98 at which an accessory, such as the grill 102 shown, is connectable to the mechanism 82 or supportable by the mechanism 82. In the embodiment depicted, the accessory holding portion 98 is a table member defining at least one planar surface 106 on which an accessory is supportable by the mechanism 82. The grill 102 is shown in FIGS. 2-4 being supported by surface 106.

Figure 5:
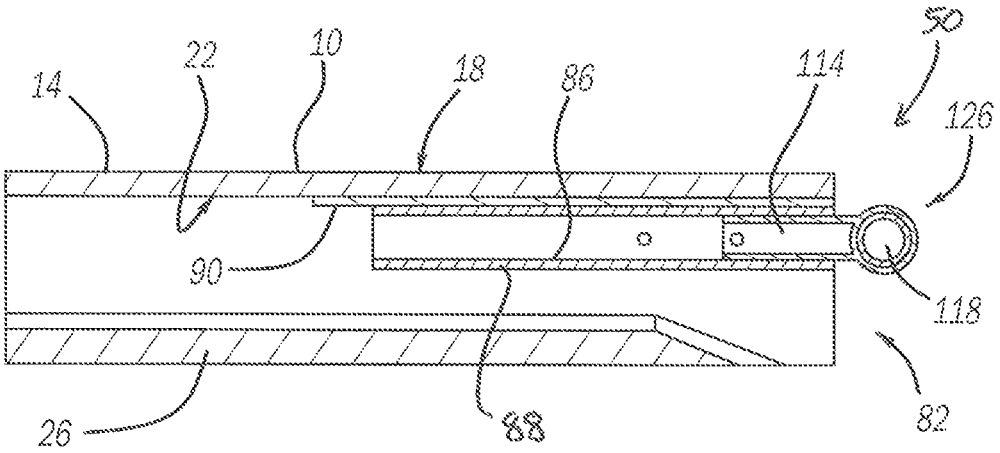
FIG. 5 is a schematic, cross-sectional, side view of a portion of the boat and the accessory attachment system in a second configuration.
Figure 6:
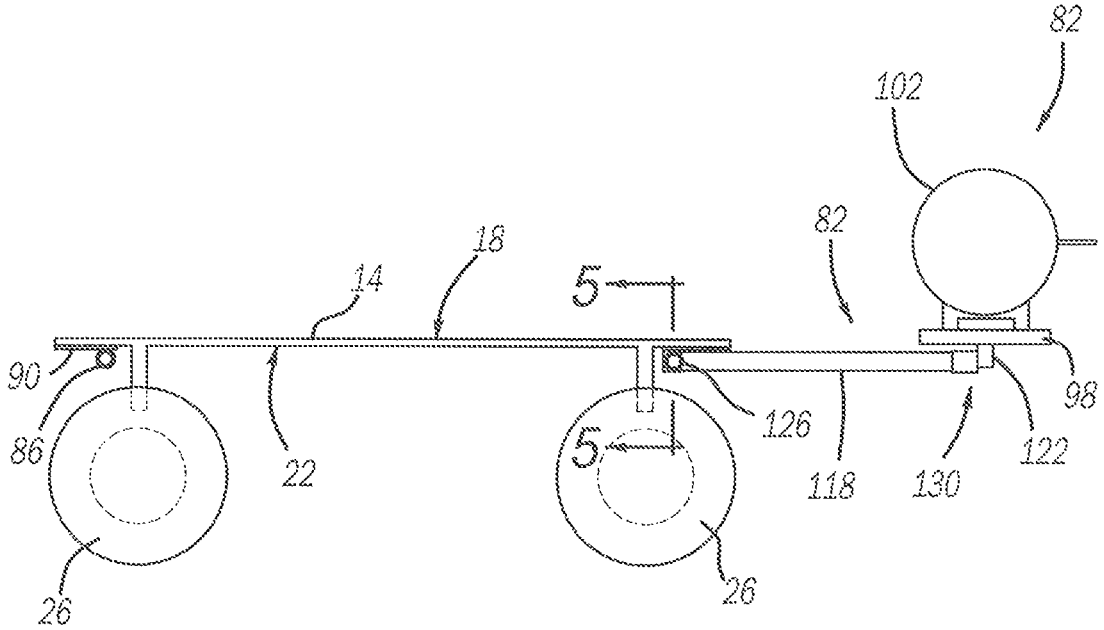
FIG. 6 is a schematic, rear view of the boat with the accessory attachment system in the second configuration.
Figure 7:
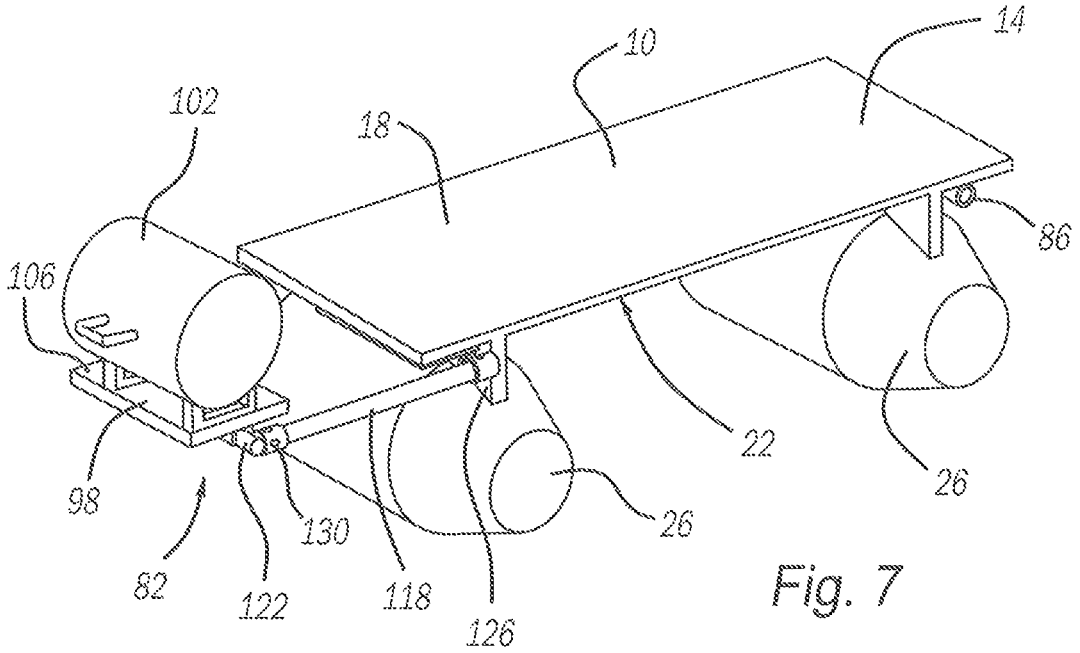
FIG. 7 is a schematic, perspective view of a portion of the boat with the accessory attachment system in the second configuration.

The mechanism 82 is reconfigurable such that the accessory holding portion 98 is selectively movable relative to the boat 10. For example, the mechanism 82 is reconfigurable between a first configuration, as shown in FIGS. 2-4, and a second configuration, as shown in FIGS. 5-7.

In the embodiment depicted, the mechanism 82 includes a first segment 114, a second segment 118, and a third segment 122. A first joint 126 interconnects the first and second segments 114, 118 such that the second segment 118 extends perpendicularly to the first segment 114. A second joint 130 interconnects the second and third segments 118, 122 such that the third segment 122 extends perpendicularly to the second segment 118.

The first joint 126 is configured such that the second segment 118 is selectively rotatable relative to the first segment 114 about an axis of rotation that extends along the centerline of the first segment. The second joint 130 is configured such that the third segment 122 is selectively rotatable relative to the second segment 118 about an axis of rotation that extends along the centerline of the second segment. The first segment 118 is insertable into one of the receivers 86 mounted to the underside of the deck 14 of the boat 10, and is selectively rotatable relative to the receiver 86.

Referring specifically to FIGS. 2-4, in the first configuration, the first segment 114 extends in the fore and aft direction (relative to the boat 10) from the receiver 86 to a point forward of the bow 50. The second segment 118 extends vertically forward of the bow 50, and the third segment 122 extends transversely or laterally with respect to the boat 10 (i.e., perpendicularly to both the first segment 114 and the second segment 118.

The accessory holding portion 98 is attached to the third segment 122, and the grill 102 is placed on one of the surfaces 106 of the accessory holding portion 98 to be supported in the position shown in FIGS. 2-4. In the first configuration, the attachment portion 98 is in a position to support the grill 102 where the grill 102 is usable by a person on the deck 14 in the passenger area 30. More specifically, the attachment portion 98 and therefore the grill 102, is above the deck 14 and the upper edge of the fencing 34 when the mechanism 82 is in the first configuration.

Referring to FIGS. 5-7, the mechanism is movable from the first configuration to the second configuration by rotating the first, second, and third segments 114, 118, 122 about the joints 126, 130 and/or rotating the first segment 114 relative to the receiver 86 such that the second segment 118 is substantially horizontal, and the attachment portion 98, and therefore the grill 102, are moved downward, rearward, and rightward relative to the boat from the first configuration. When the mechanism 82 is in the second configuration, the grill 102 is in a position for use by a person in the water adjacent the boat.

Accordingly, the accessory attachment system enables a user to place accessories in various positions relative to the boat. Other accessories attachable or supportable by the attachment portion 98 may include lights, speakers, fishing equipment, etc.

In the embodiment depicted, the joints 126, 130 are formed by collars into which the segments extend, and are lockable by inserting pins into aligned holes in the collars and the segments. However, other joint configurations that provide the same functionality may be employed within the scope of the claimed invention. For example, clamps may be employed to selectively lock segments relative to one another within the scope of the claimed invention. Similarly, the receiver 86 defines holes that align with holes in the first segment 114, such that the first segment 114 is lockable relative to the receiver 86 by extending pins through the holes in the receiver and first segment.

Figure 8:
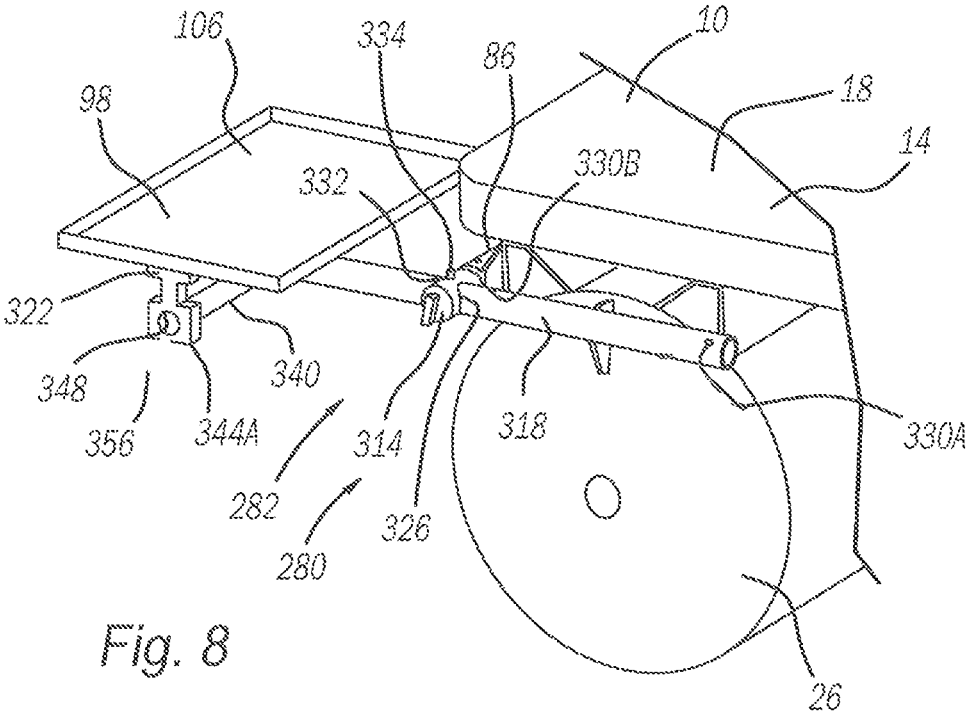
FIG. 8 is a schematic, perspective view of an alternative embodiment of an accessory attachment system within the scope of the claimed invention.
Figure 9:
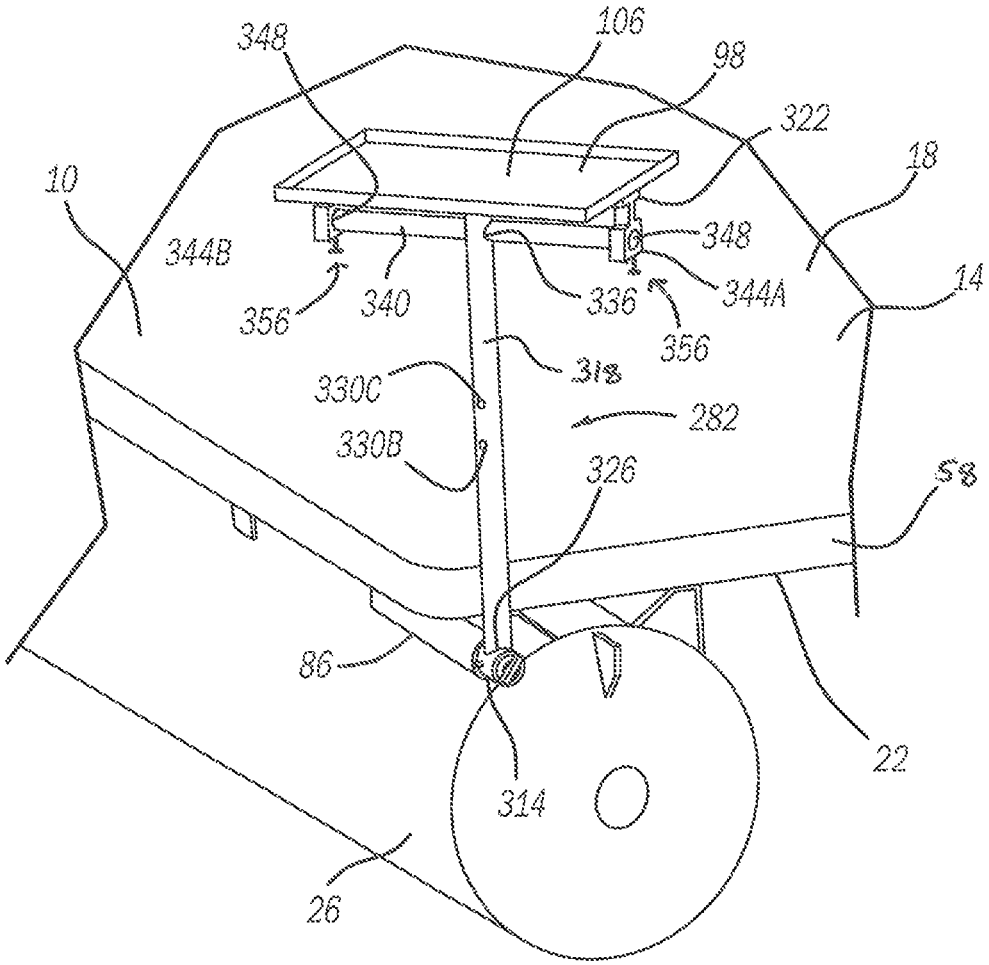
FIG. 9 is another schematic, perspective view of the accessory attachment system of FIG. 8.
Figure 10:
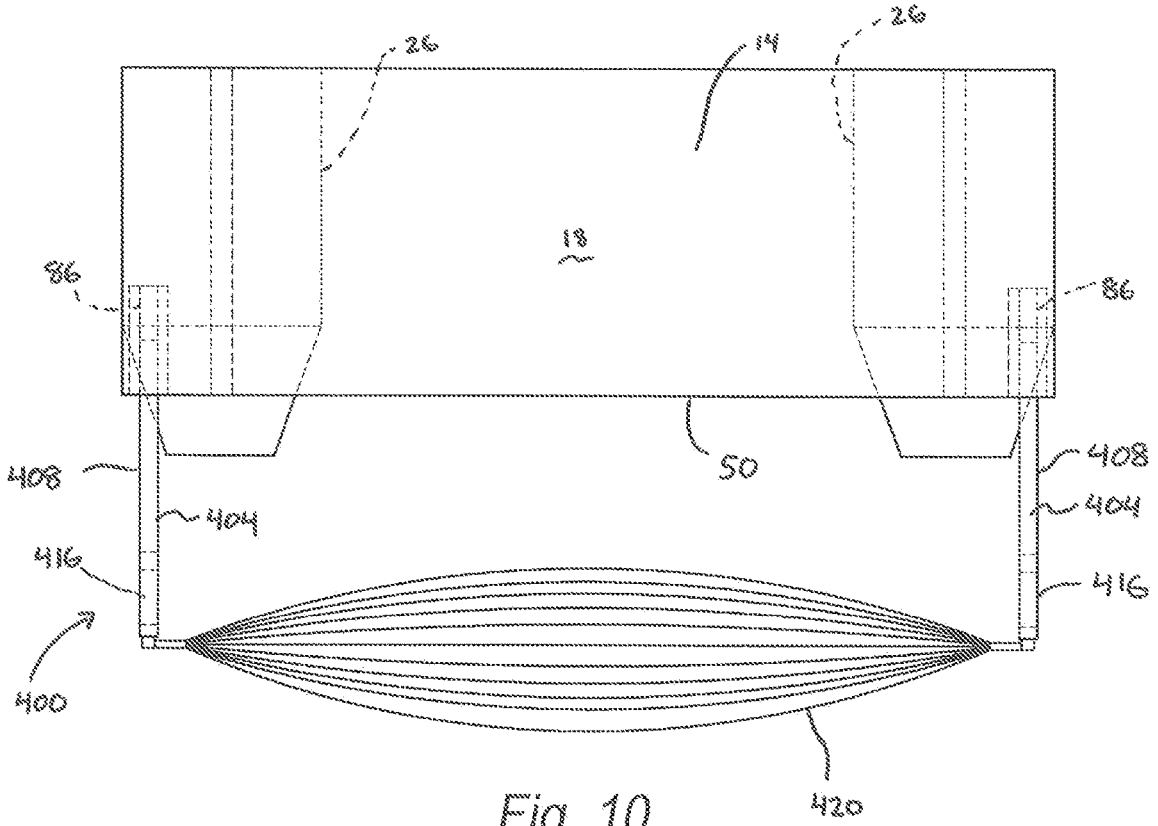
FIG. 10 is a schematic, top view of the boat with a first alternative accessory attachment system mounted thereto.
Figure 11:
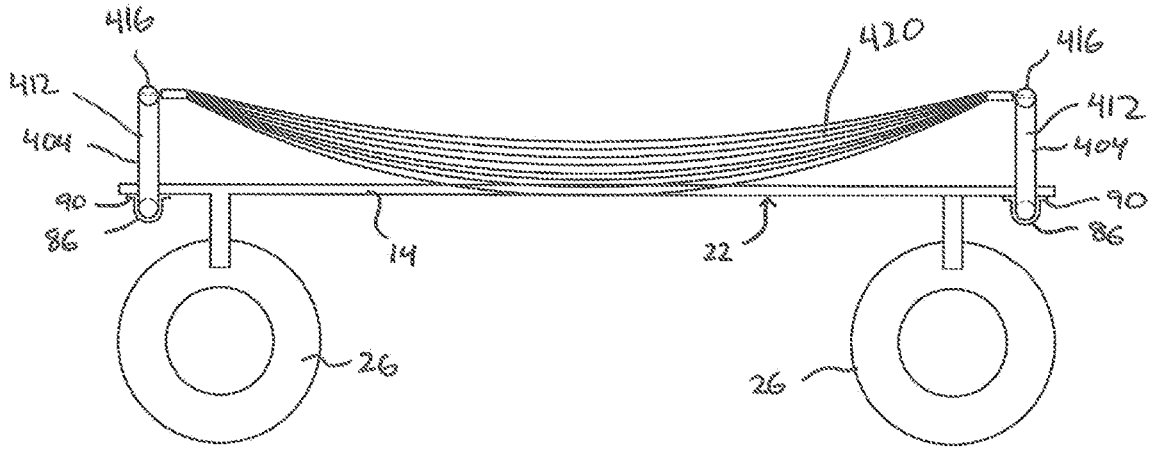
FIG. 11 is a schematic, front view of the boat with the first alternative accessory attachment system mounted thereto.
Figure 12:
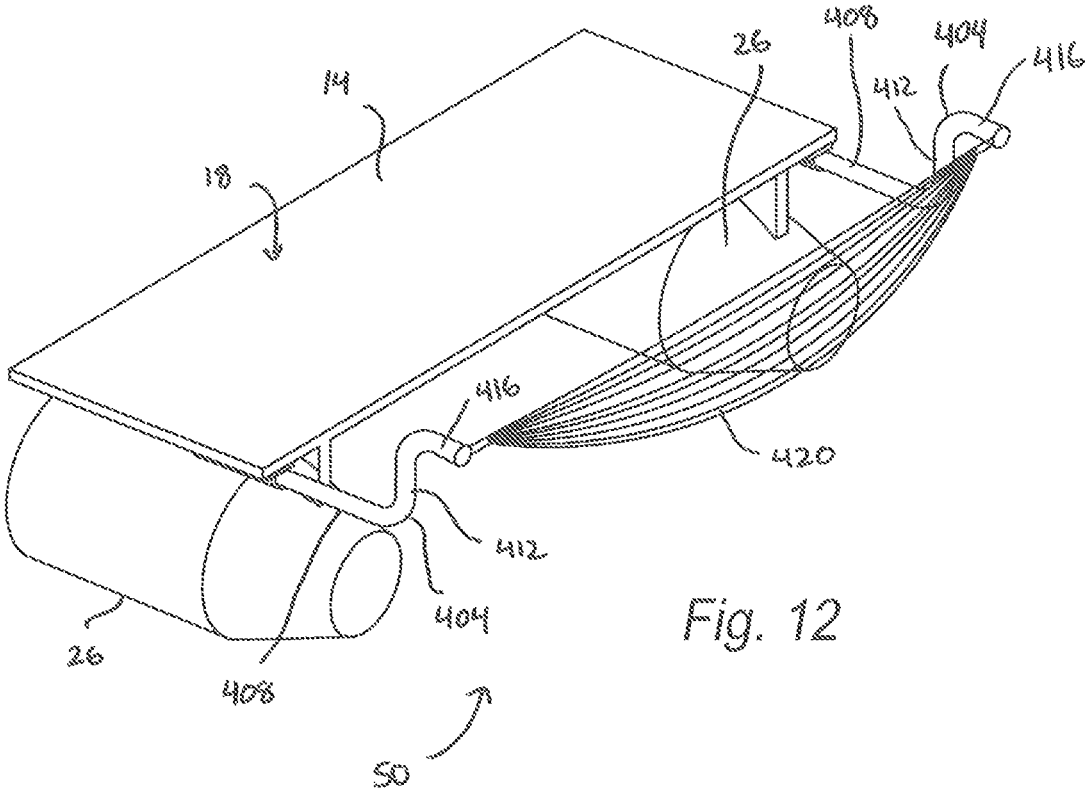
FIG. 12 is a schematic, perspective view of the boat with the first alternative accessory attachment system mounted thereto.
Figure 13:
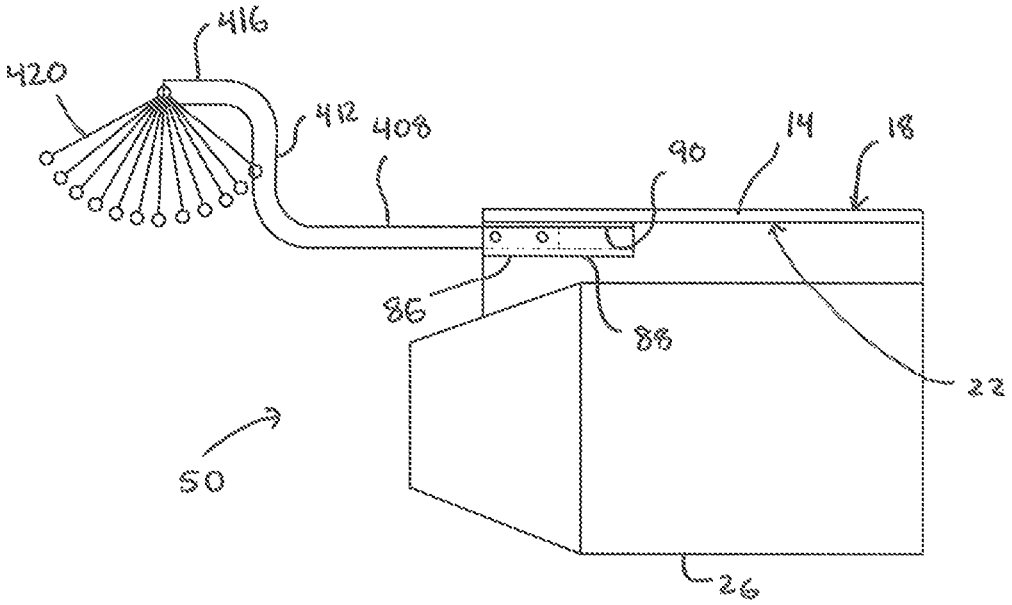
FIG. 13 is a schematic, side view of the boat with the first alternative accessory attachment system.
Figure 14:
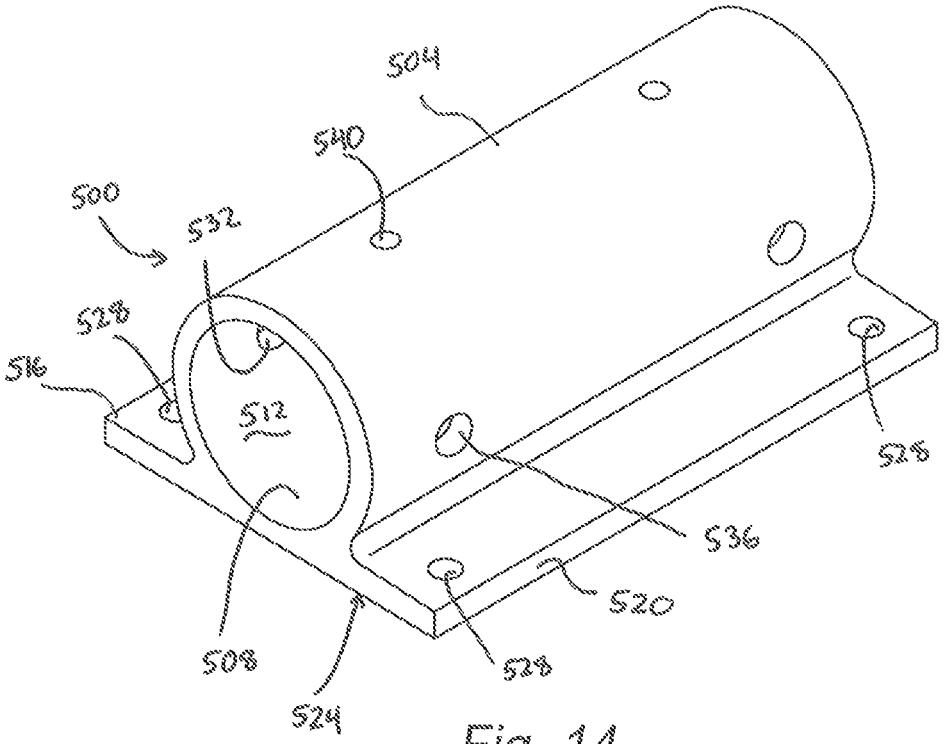
FIG. 14 is a schematic, perspective view a receiver for connecting any of the accessory attachment systems to a boat.
Figure 15:
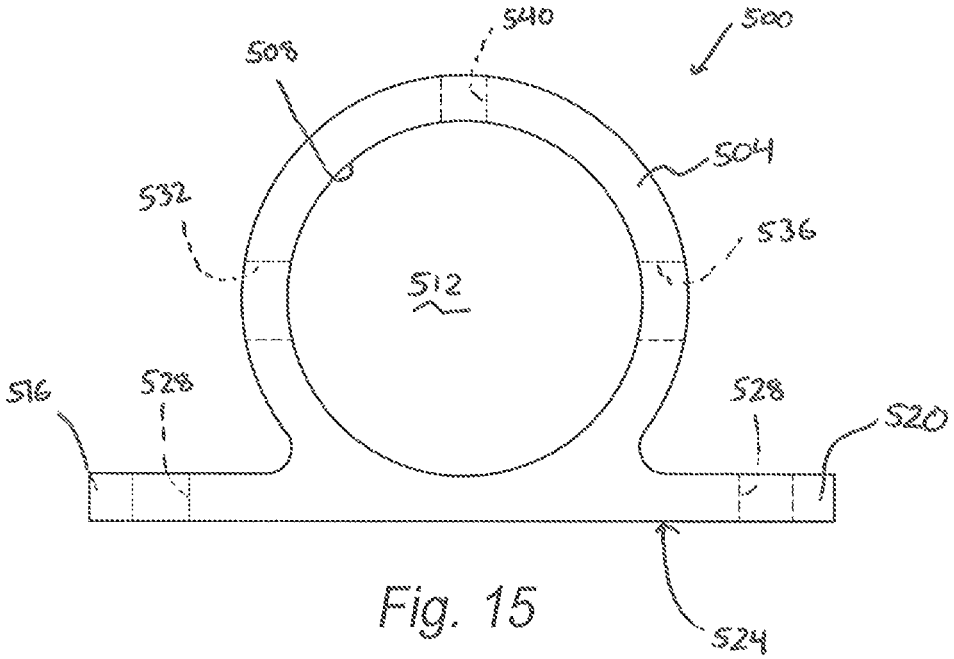
FIG. 15 is a schematic, front view of the receiver of FIG. 15.
Figure 16:
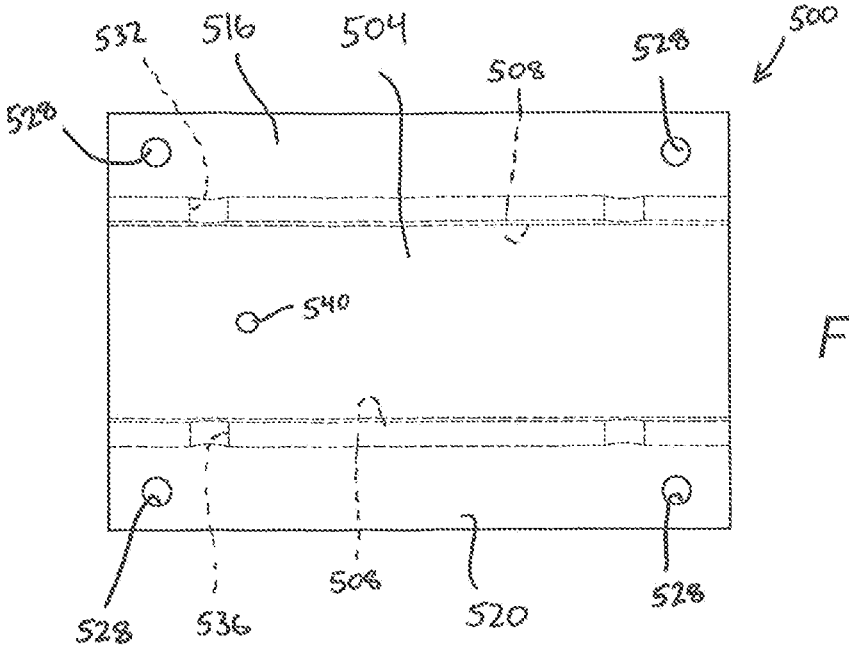
FIG. 16 is a schematic, top view of the receiver of FIG. 15.

FIGS. 8 and 9, wherein like reference numbers refer to like components from FIGS. 1-7, schematically depict another accessory attachment system 280 according to an alternative embodiment. In the embodiment depicted, the system 280 includes a mechanism 282 having a first segment 314, a second segment 318, and a third segment 322. The first segment 314 is cylindrical and is inserted into the receiver 86 in a manner similar to the first segment shown at 114 in FIGS. 2-7. In the embodiment shown in FIGS. 8 and 9, the receiver 86 is mounted below the deck 14 to a vertical surface on a bracket that interconnects one of the pontoons 26 to the deck 14 adjacent to the stern 58.

The first segment 314 is selectively rotatable relative to the receiver 86 and is selectively lockable via pins in the positions shown in FIGS. 8 and 9. The first segment 314 also defines a hole 326 that extends perpendicular to the centerline of the segment 314, i.e., the hole 326 extends through the width of the segment 314. The second segment 318 extends through the hole 326 such that the second segment 318 is perpendicular to the first segment 314. The outer diameter of the second segment 318 is slightly smaller than the diameter of the hole 326 such that the second segment 318 is slidable through the hole 326 relative to the first member 314.

The second segment 318 defines a plurality of holes 330A, 330B, 330C along its length. Hole 330A is near one end of the second segment 318, and holes 330B, 330C are near the midpoint of the second segment 318. The first segment 314 defines a hole 332 that extends from the outer surface into the hole 326. The second segment 318 is lockable relative to the first segment 314 by aligning one of the holes 330A, 330B, 330C with the hole 332 and then inserting a pin 334 through hole 332 and one of holes 330A, 330B, 330C.

The second segment 318 defines another hole 336 extending therethrough. Hole 336 is perpendicular to the centerline of the second segment 318. A cylindrical member 340 extends through the hole 336 such that the cylindrical member 340 is perpendicular to the second segment 318. The third segment 322 is rotatably connected to member 340 via two clamps 344A, 344B.

More specifically, each clamp 344A, 344B defines a respective cylindrical hole 348 through which member 340 extends so that the clamps 344A, 344B are rotatable about an axis that is coextensive with the centerline of the member 340 and perpendicular to the second segment 318. Each clamp 344A, 344B also includes a respective hand knob 356 that varies the clamping force exerted by the clamps 344A, 344B on the member 340. Accordingly, the rotation of clamps 344A, 344B, and therefore the rotation of the third segment 322, relative to the member 340 and segment 318, is prevented by rotating the hand knobs 356 in one direction to increase the clamping force on the member 340. If a user desires to alter the angular position of the third segment 322 relative to the member 340 and the second segment 318, the user may rotate the knobs 356 in the opposite direction to permit rotation of the third segment 322.

Accordingly, the clamps 344A, 344B permit fine adjustments to the angular position of the third segment 322. The accessory holding portion 98 is rigidly connected to the third segment 322 for unitary movement therewith, and thus the angular position of the accessory holding portion 98 is adjustable via the clamps 344A, 344B.

In FIG. 9, the first segment 314 is positioned relative to the receiver 86 and the boat 10 so that the second segment 318 is vertically oriented. The pin 334 extends through hole 330A, and thus the distance from the receiver 86 to the accessory holding portion 98 is maximized. The surface 106 faces upward to support a grill or other accessory.

In FIG. 8, the first segment 314 has been rotated ninety degrees relative to the receiver 86 from its position in FIG. 9. The second segment 318 has been slid through the hole 326 so that the pin 334 is inserted through hole 330C; accordingly, the distance between the receiver 86 and the accessory holding portion 98 has been shortened compared to FIG. 9. The third segment 322, and therefore the accessory holding portion 98, has been rotated about approximately ninety degrees relative to the second segment 318 from the position shown in FIG. 9 so that, despite the rotation of the second segment 318, the surface 106 maintains its upwardly-facing orientation.

FIGS. 10-13 schematically depict a portion of the boat 10 with another accessory attachment system 400 in accordance with the claimed invention. Referring to FIGS. 10-13, wherein like reference numbers refer to like components from FIGS. 1-9, the accessory attachment system 400 includes two bracket members 404. Each of the bracket members 404 extends partially into a respective one of the two receivers 86 mounted to the lower surface 22 of the deck 14, thereby securing each bracket member 404 relative to the boat 10.

In the embodiment depicted, each bracket member 404 includes a respective first segment 408, a respective second segment 412, and a respective third segment 416, though other bracket member configurations may be employed within the scope of the claimed invention. Each of the first segments 408 is cylindrical and is inserted into a respective one of the receivers 86 in a manner similar to the first segment shown at 114 in FIGS. 2-7. Each of the first segments 408 is secured to a respective receiver 86 by extending pins through the holes in the receiver and first segment 408. The first segments 408 extend from the receivers 86 substantially horizontally forward of the forward edge of the deck 14; the second segments 412 extends substantially vertically from the first segments 408; and the third segments 416 extend horizontally from the second segments 146.

The two bracket members 404 support an accessory, such as a hammock 420, therebetween. The hammock 420 comprises a flexible material, such as a fabric, and may be used to support a reclining human in the manner understood by those skilled in the art. The hammock 420 is attached to both of the bracket members 404 at their distal ends, i.e., at the ends of segments 416. Accordingly, the hammock 420 is suspended above the water forward of the bow 50 of the boat 10. The hammock 420 is supported by the two bracket members 404, i.e., one end of the hammock 420 is attached to one of the brackets 404, and the other end of the hammock 420 is attached to the other one of the brackets 404.

Those skilled in the art will recognize suitable hammock materials and configurations. For example, and without limitation, the hammock 420 may be a rope hammock, a mesh hammock, a cotton or other fabric hammock, etc. The hammock 420 may or may not include spreader bars.

It should be noted that the receivers 86 mounted to the underside of the deck 14 form an attachment interface at which a variety of differently-configured boating accessories and hardware may be mounted to the boat 10 in a manner that does not occupy any valuable space in the passenger area 30. Thus, an owner of the boat 10 with the receivers 86 installed may select from a plurality of different accessories adapted to engage with the receiver 86 and thus to the boat 10. For example, an owner may select and attach the accessory mounting system shown at 82, the attachment system shown at 400, the docking system shown and described in U.S. Patent publication number 2021/0331770, or the docking system shown and described in U.S. Patent publication number 2022/0177085 to the boat 10 via the receivers 86. U.S. Patent publication number 2021/0331770, published on Oct. 28, 2021, is hereby incorporated by reference in its entirety. U.S. Patent publication number 2022/0177085, published on Jun. 9, 2022, is hereby incorporated by reference in its entirety.

The receiver 86 in the embodiment of FIGS. 1-13 is formed from two pieces, namely a plate that forms the flange portion 90, and the tubular portion 88, which is welded to the plate. FIGS. 14-17, wherein like reference numbers refer to like components from FIGS. 1-13, schematically depict a receiver 500 according to an alternative embodiment that may be used in place of the receivers shown at 86. Referring to FIGS. 14-17, the receiver 500 includes tubular portion 504 having an inner surface 508 that defines a cylindrical bore 512.

The receiver 500 also includes two flanges 516, 520 that are connected to the tubular portion 504. The flanges 516, 520 are coplanar with each other and coplanar with a plane that is substantially tangential to the tubular portion 504. The flanges 516, 520 cooperate to define a flat, substantially planar surface 524 for mounting the tubular portion 504 to a flat surface, e.g. the lower surface 22, of the boat 10, and thus eliminate the need for the plate shown at 90.

The flanges 516, 520 define a plurality of holes 528 through which threaded fasteners may extend to attach the receiver 204 to the boat, and more specifically such that surface 528 abuts a surface of the boat 10. The tubular portion 504 also defines a plurality of holes 532, 536, 540. The receiver 500 is configured to operatively connect various hardware, such as the mechanism shown at 82 in FIGS. 1-7, the mechanism shown at 282 in FIGS. 8-9, the members shown at 404 in FIGS. 10-13, the docking systems shown in U.S. Patent Publications 2021/0331770 and 2022/0177085, to the boat 10. The receiver 500 thus provides a common attachment interface for a plurality of various hardware components, thereby providing a boat owner with a single attachment system for a wide variety of optional equipment.

Figure 17:
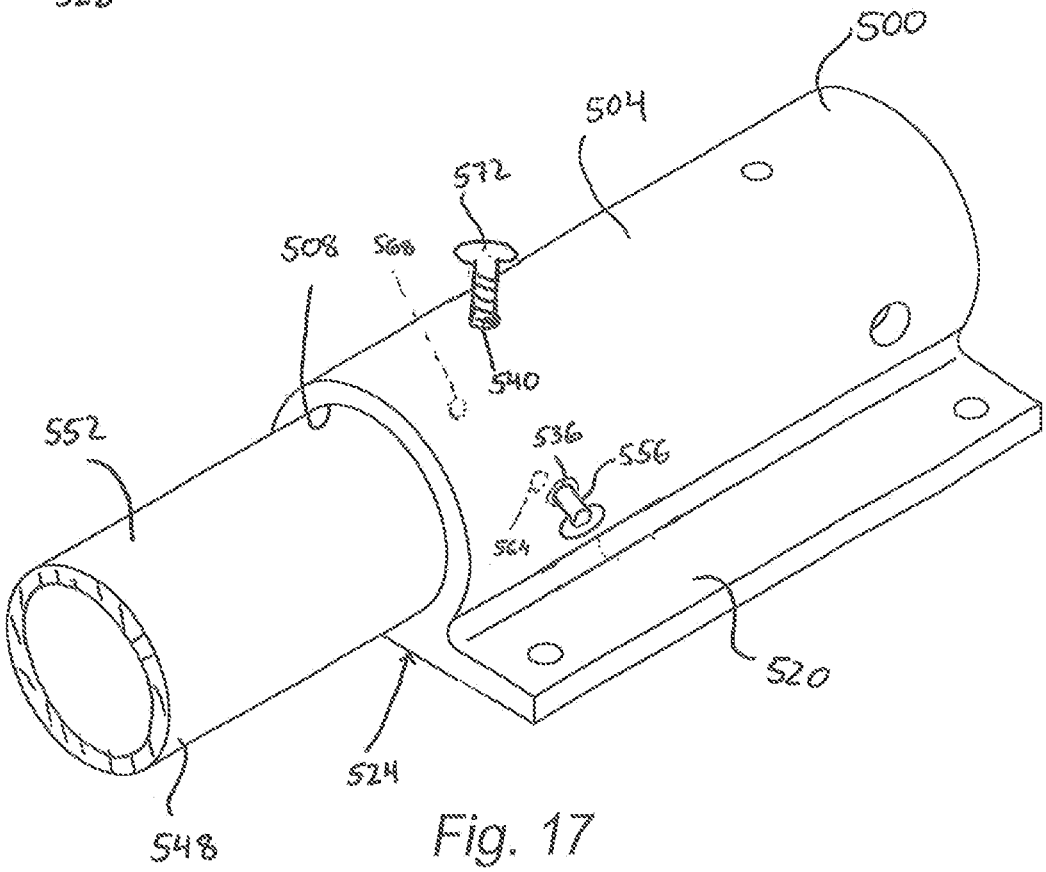
FIG. 17 is schematic, perspective view of the receiver of FIG. 15 engaged with a cylindrical member.

The receiver 500 is configured to receive a member 548 having a cylindrical outer surface 552. Member 548 is representative of segments 114, 314, and 408, and is therefore illustrative of the interaction between segments 114, 314, 408 and the receiver 500. The outer diameter of the member 548 is slightly less than the diameter of the bore 512, and thus, the member 548 is insertable into the bore 512 of the receiver 500 as shown in FIG. 17, with surface 552 contacting surface 508.

To retain the member 548 in the position shown relative to the receiver 500, a pin 556 is inserted through holes 532, 536 in the receiver 500 and through holes 564, 568 in the member 548, thereby preventing movement of the member 548 relative to the receiver 500. In the embodiment depicted, a set screw 572 extends through hole 540 so that the set screw 572 acts on the outer surface 552, further limiting relative movement of the member 548 relative to the receiver 500.

The receiver 500, including the tubular portion 504 and the flanges 516, 520, is formed from a single piece of material, such as aluminum. In the embodiment depicted, the receiver 500 is formed by extruding an aluminum blank into the shape shown and described. The receiver 500 provides improved durability and strength compared to the welding of a tube onto a plate, and provides flexibility in the manufacture of receivers of differing lengths.

It should be noted that, although the receivers 86, 500 are depicted mounted to a watercraft, such as boat 10, the receivers 86, 500 may be employed in other environments within the scope of the claimed invention. For example, and without limitation, two receivers 500 may be mounted to the upper surface of a seawall (not shown). Brackets such as the ones shown at 404 may be engaged with the receivers 500 on the seawall such that a hammock is supported above the body of water adjacent to the seawall.

While the best modes for carrying out the invention have been described in detail, those familiar with the art to which this invention relates will recognize various alternative designs and embodiments for practicing the invention within the scope of the appended claims.

The invention claimed is:

1. A watercraft comprising:

a deck;

at least one surface below the deck;

a first accessory attachment interface mounted to said at least one surface;

a second accessory attachment interface mounted to said at least one surface;

said first accessory attachment interface including a one-piece extruded aluminum member having a tubular portion and a flange portion, said tubular portion defining a respective cylindrical bore, said flange portion defining first and second flanges, said first and second flanges being coplanar with each other and a plane that is tangential to the tubular portion, and said first and second flanges cooperating with each other to define a substantially planar surface; and wherein the second accessory attachment interface is substantially identical to the first accessory mounting interface;

a first bracket member extending horizontally from the bore of the first accessory attachment interface past an edge of the deck; and a second bracket member extending horizontally from the bore of the second accessory attachment past the edge of the deck; and a hammock mounted at one end to the first bracket member and mounted at the other end to the second bracket member.

2. The watercraft of claim 1, wherein the boat has a bow, and wherein the hammock is forward of the bow.

* * * * *